US007481091B1

(12) United States Patent
Grant et al.

(10) Patent No.: US 7,481,091 B1
(45) Date of Patent: Jan. 27, 2009

(54) MATERIAL PROCESSING SYSTEM

(76) Inventors: David F. Grant, 09269 Block 770, Yishun Ave 3, Singapore (SG) 760770; Patrick B. Berbon, 20 Corte Ellena, Walnut Creek, CA (US) 94598; Timothy C. Wang, 9007 Princeton Way, Buena Park, CA (US) 90620; Paul A. Burkey, 6529 Via Del Prado, Chino Hills, CA (US) 91709

( * ) Notice: Subject to any disclaimer, the term of this patent is extended or adjusted under 35 U.S.C. 154(b) by 0 days.

(21) Appl. No.: 11/494,249

(22) Filed: Jul. 27, 2006

(51) Int. Cl.
*B21C 23/00* (2006.01)

(52) U.S. Cl. ..... 72/262; 72/253.1

(58) Field of Classification Search ..... 72/253.1, 72/261, 259, 262, 264, 269, 272, 467
See application file for complete search history.

(56) References Cited

U.S. PATENT DOCUMENTS 3,765,216 A * 10/1973 Green ..... 72/262
3,934,446 A * 1/1976 Avitzur ..... 72/206
4,068,512 A * 1/1978 Fuchs, Jr. ..... 72/41
4,362,485 A * 12/1982 Slater et al. ..... 425/79
4,953,382 A * 9/1990 Ashok et al. ..... 72/262
7,152,448 B2 * 12/2006 Zhu et al. ..... 72/262

* cited by examiner

*Primary Examiner*—Edward Tolan
(74) *Attorney, Agent, or Firm*—Edward P Dutkiewicz

(57) ABSTRACT

A drive wheel has a generally cylindrical exterior surface with a circumferential groove. A block has a cylindrical working surface in sliding contact with the drive wheel, an operational face with an opening there through. A die is located in the opening and has an interior surface constituting a continuation of the working surface of the block. The die has an exit opening. A diverter is secured to the die and extends into the recess with a leading abutment edge positioned in operative proximity to the exit opening.

4 Claims, 5 Drawing Sheets

FIG 1
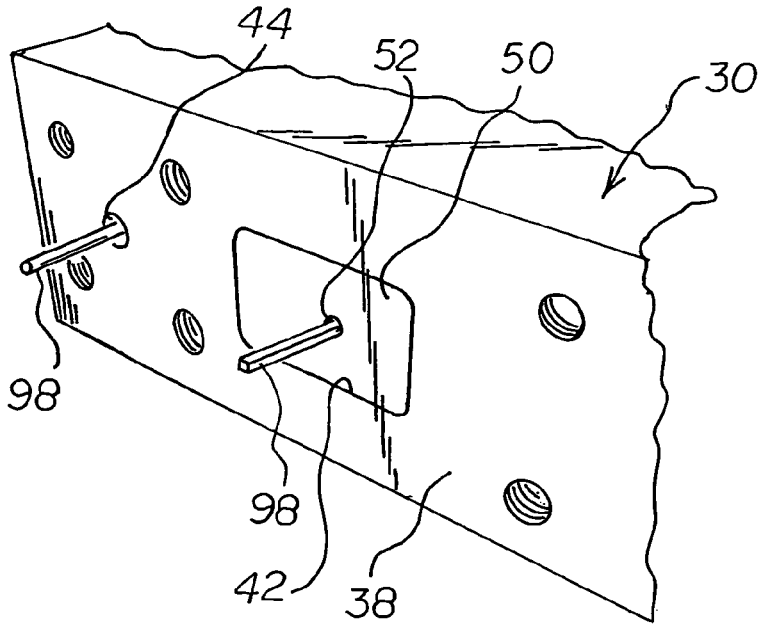
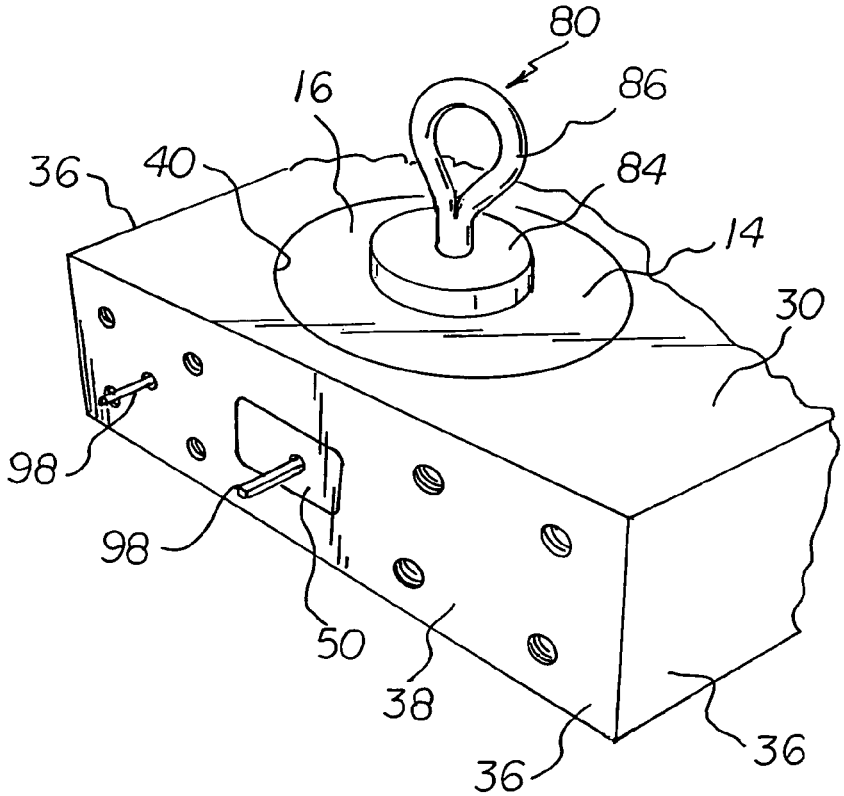
FIG 2

FIG 3
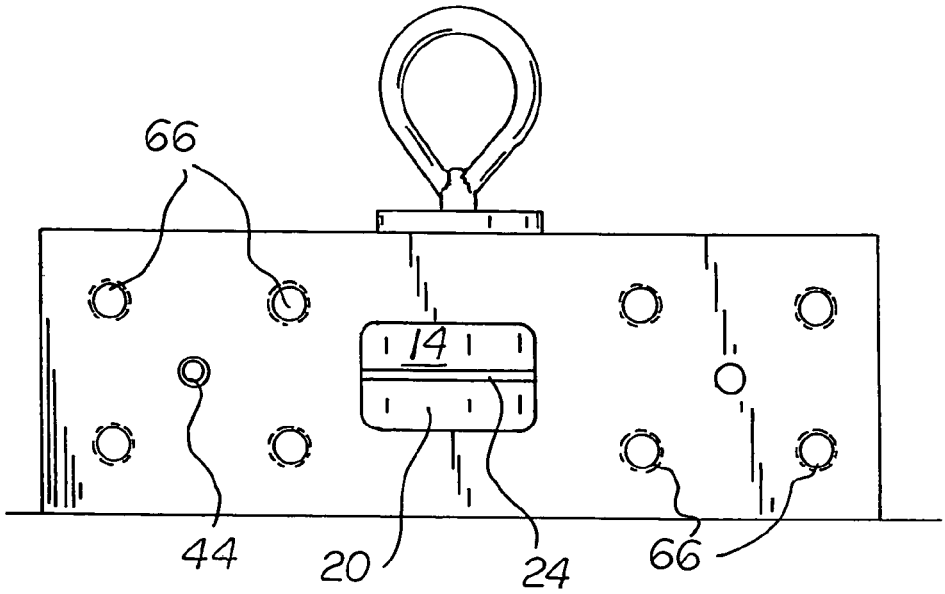
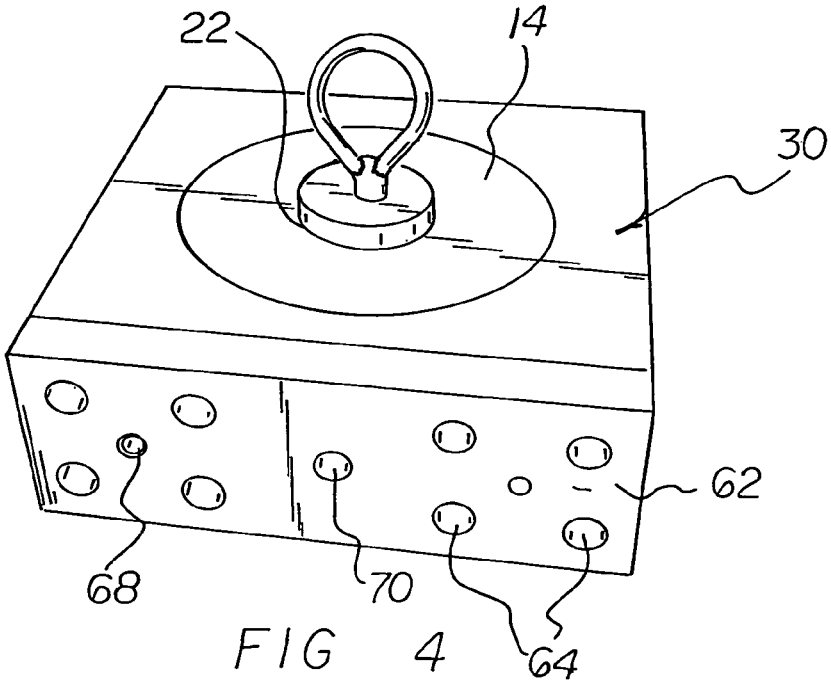
FIG 4

MATERIAL PROCESSING SYSTEM

BACKGROUND OF THE INVENTION

1. Field of the Invention

The present invention relates to a material processing system and more particularly pertains to continuously processing ultra-fine grain size materials.

2. Description of the Prior Art

The use of material processing systems of known designs and configurations is known in the prior art. More specifically, material processing systems of known designs and configurations previously devised and utilized are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe a material processing system that allows continuously processing ultra-fine grain size materials.

In this respect, the material processing system according to the present invention substantially departs from the conventional concepts and designs of the prior art, and in doing so provides an apparatus primarily developed for the purpose of continuously processing ultra-fine grain size materials.

Therefore, it can be appreciated that there exists a continuing need for a new and improved material processing system which can be used for continuously processing ultra-fine grain size materials. In this regard, the present invention substantially fulfills this need.

SUMMARY OF THE INVENTION

In view of the foregoing disadvantages inherent in the known types of material processing systems of known designs and configurations now present in the prior art, the present invention provides an improved material processing system. As such, the general purpose of the present invention, which will be described subsequently in greater detail, is to provide a new and improved material processing system which has all the advantages of the prior art and none of the disadvantages.

To attain this, the present invention essentially comprises a material processing system for continuously processing ultra-fine grain size materials which is comprised of a plurality of components. First, a drive wheel is provided. The drive wheel has a planar upper face and a parallel planar lower face with a generally cylindrical exterior surface located between the upper and lower faces. A centrally located square interior drive extends between the upper and lower faces. The exterior surface has a circumferential groove with a square cross sectional configuration midway between the upper and lower faces. A threaded aperture with a set screw extends between the drive hole and the exterior surface at an elevation between the groove and the upper face.

Next provided is a rectilinear block. The rectilinear block has a planar upper face and a parallel planar lower face. The rectilinear block has a rectilinear exterior surface formed of four rectangular faces including an operational face located between the upper and lower faces and a centrally located cylindrical working surface in sliding contact with the drive wheel. A generally centrally located rectangular opening extends through the operational face. The operational face also has a circular entrance opening located offset from the rectangular opening and extending to an output location tangential of the wheel and the groove. The entrance opening may be located on any of the four sides of the rectilinear block.

A die is next provided. The die is located in the rectangular opening with a square exit extending from an input location interior of the die to a round relief exit then to an output location radially extending from the wheel and the groove. The die has an interior surface constituting a continuation of the cylindrical working surface of the rectilinear block.

Next, an elongated arcuate diverter is provided. The diverter has a square cross section secured to the die and extending into the recess. A leading abutment edge is positioned in operative proximity to the exit opening.

A backing plate is next provided. The backing plate is removably positioned over the operational face of the rectilinear block with unthreaded apertures extending through the backing plate and aligned with threaded apertures in the rectilinear block. Bolts are positioned though the unthreaded apertures and coupled to the threaded apertures to hold the die in place during operation and use. The backing plate has an entrance port aligned with the entrance opening of the rectilinear block and an exit port aligned with the exit opening of the die.

Next, a containment collar is provided. The containment collar has a rectangular opening for receiving and supporting the rectilinear block and the backing plate. The containment collar has intake and extrusion holes for movement of the workpiece there through.

A drive shaft is next provided. The drive shaft includes a rectangular upper section adapted to extend into the drive slot of the drive wheel and a circular plate adapted to be positioned on a central extent of the rectilinear block. A hook extends upwardly from the circular plate to facilitate the raising and lowering of the drive wheel with respect to the rectilinear block.

A work table is next provided for receiving the rectilinear block and the backing plate and the containment collar. The work table has a central opening beneath the drive hole of the wheel.

Lastly, a motor is provided. The motor is secured to the work table beneath the central opening of the work table. An upstanding rectilinear drive shaft is removably received within the drive slot of the drive wheel for rotating the wheel within the drive block to drive and pull a workpiece with an initial circular configuration into the square groove of the drive wheel in a path of travel to the abutment edge of the arcuate diverter then into the square exit which then opens into a round relief opening of the die and exterior of the system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved material processing system which has all of the advantages of the prior art material processing systems of known designs and configurations and none of the disadvantages.

It is another object of the present invention to provide a new and improved material processing system which may be easily and efficiently manufactured and marketed.

It is further object of the present invention to provide a new and improved material processing system which is of durable and reliable construction.

An even further object of the present invention is to provide a new and improved material processing system which is susceptible of a low cost of manufacture with regard to both materials and labor, and which accordingly is then susceptible of low prices of sale to the consuming public, thereby making such material processing system economically available to the buying public.

Even still another object of the present invention is to provide a material processing system for continuously processing ultra-fine grain size materials.

Lastly, it is an object of the present invention to provide a new and improved material processing system with a drive wheel having a generally cylindrical exterior surface with a circumferential groove. A block has a cylindrical working surface in sliding contact with the drive wheel, an operational face with an opening there through. A die is located in the opening and has an interior surface constituting a continuation of the working surface of the block. The die has an exit opening. A diverter is secured to the die and extends into the recess with a leading abutment edge positioned in operatively proximity to the exit opening. By operative proximity it is meant to include immediately following the exit opening or a short distance beyond the exit opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the block and die of a material processing system constructed in accordance with the principles of the present invention.

FIG. 2 is a perspective illustration of the block and die of a material processing system shown in FIG. 1 along with the drive system.

FIG. 3 is a front elevational view of the components illustrated in FIG. 2 but with the backing plate attached.

FIG. 4 is a perspective illustration similar to FIG. 2 but with the backing plate attached.

The same reference numerals refer to the same parts throughout the various Figures.

DESCRIPTION OF THE PREFERRED EMBODIMENT

Figure 5:
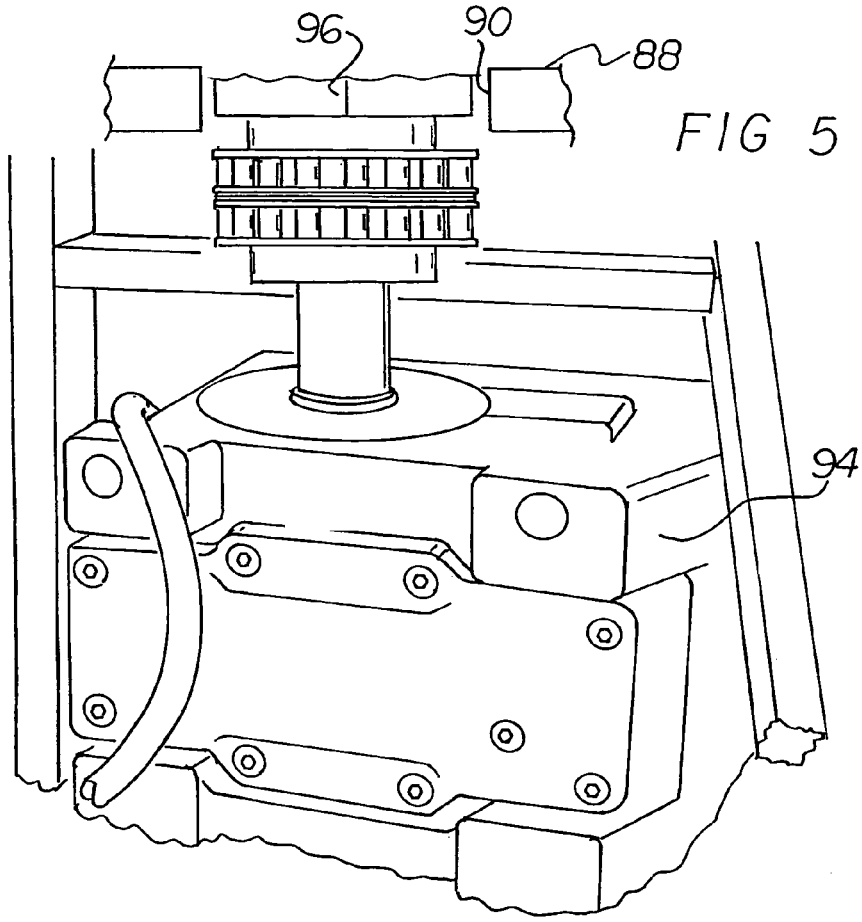
FIG. 5 is a perspective illustration of the work table and motor.
Figure 6:
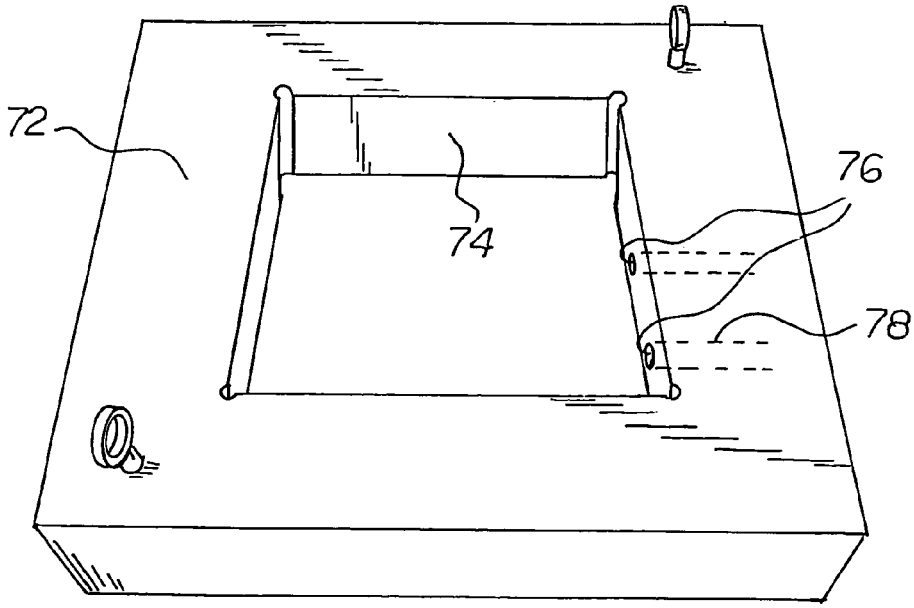
FIG. 6 is a perspective illustration of the containment collar.
Figure 7:
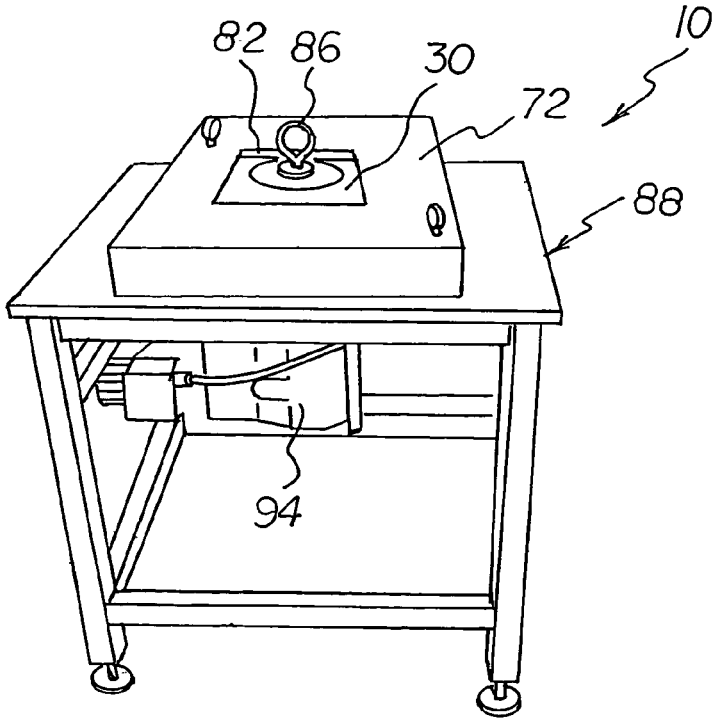
FIG. 7 is a perspective illustration of the work table and block with the drive wheel in place and the motor and containment collar attached.
Figure 8:
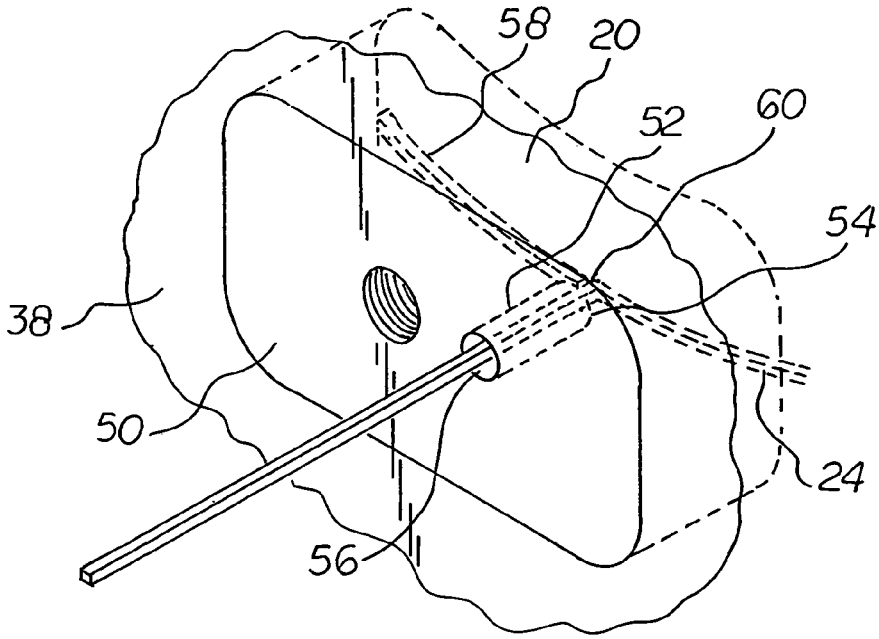
FIG. 8 is an enlarged perspective illustration of the block and die and also showing the workpiece.

With reference now to the drawings, and in particular to FIGS. 1 and 7 thereof, the preferred embodiment of the new and improved material processing system embodying the principles and concepts of the present invention and generally designated by the reference numeral 10 will be described.

The present invention, the material processing system 10 for continuously processing ultra-fine grain size materials is comprised of a plurality of components. Such components in their broadest context include a drive wheel, a block, a die and a diverter. Such components are individually configured and correlated with respect to each other so as to attain the desired objective.

First, a drive wheel 14 is provided. The drive wheel has a planar upper face 16 and a parallel planar lower face with a generally cylindrical exterior surface 40 located between the upper and lower faces. A centrally located square interior drive 22 extends between the upper and lower faces. The exterior surface has a circumferential groove 24 with a square cross sectional configuration midway between the upper and lower faces. A threaded aperture with a set screw extends between the drive hole and the exterior surface at an elevation between the groove and the upper face.

Next provided is a rectilinear block 30. The rectilinear block has a planar upper face and a parallel planar lower face. The rectilinear block has a rectilinear exterior surface formed of four rectangular faces 36 including an operational face 38 located between the upper and lower faces and a centrally located cylindrical working surface 40 in sliding contact with the drive wheel. A generally centrally located rectangular opening 42 extends through the operational face. The operational face also has a circular entrance opening 44 located offset from the rectangular opening and extending to an output location tangential of the wheel and the groove. The entrance opening may be located on any of the four sides of the rectilinear block.

A die 50 is next provided. The die is located in the rectangular opening with a square exit extending from an input location 54 interior of the die to a round relief exit 52 then to an output location 56 radially extending from the wheel and the groove. The die has an interior surface constituting a continuation of the cylindrical working surface of the rectilinear block.

Next, an elongated arcuate diverter 58 is provided. The diverter has a square cross section secured to the die and extending into the recess between the entrance and exit openings. A leading abutment edge 60 is positioned in operative proximity to the exit opening. Operative proximity it is meant to include immediately following the exit opening or a short distance beyond the exit opening.

A backing plate 62 is next provided. The backing plate is removably positioned over the operational face of the rectilinear block with unthreaded apertures 64 extending through the backing plate and aligned threaded apertures 66 in the rectilinear block. Bolts are positioned though the unthreaded apertures and coupled to the threaded apertures to hold the die in place during operation and use. The backing plate has an entrance port 68 aligned with the entrance opening of the rectilinear block and an exit port 70 aligned with the exit opening of the die.

Next, a containment collar 72 is provided. The containment collar has a rectangular opening 74 for receiving and supporting the rectilinear block and the backing plate. The containment collar has intake and extrusion holes 78 and 76 for movement of the workpiece there through.

A drive shaft 80 is next provided. The drive shaft includes a rectangular base 96 below adapted to extend into the drive hole of the drive wheel and a circular plate 84 adapted to be positioned on a central extent of the rectilinear block. A hook 86 extends upwardly from the circular plate to facilitate the raising and lowering of the drive wheel with respect to the rectilinear block.

A work table 88 is next provided for receiving the rectilinear block and the backing plate and the containment collar. The work table has a central opening 90 beneath the drive hole of the wheel.

Lastly, a motor 94 is provided. The motor is secured to the work table beneath the central opening of the work table. An upstanding rectilinear drive block 96 is removably received within the drive hole of the drive wheel for rotating the wheel within the drive block to drive and pull a workpiece 98 with an initial circular configuration into the square groove of the drive wheel in a path of travel to the abutment edge of the arcuate diverter then into the square exit which then opens into a round relief opening of the die and exterior of the system. It is at the abutment edge that the massive shear, required to produce the reduction in grain size, occurs.

Figure 9:
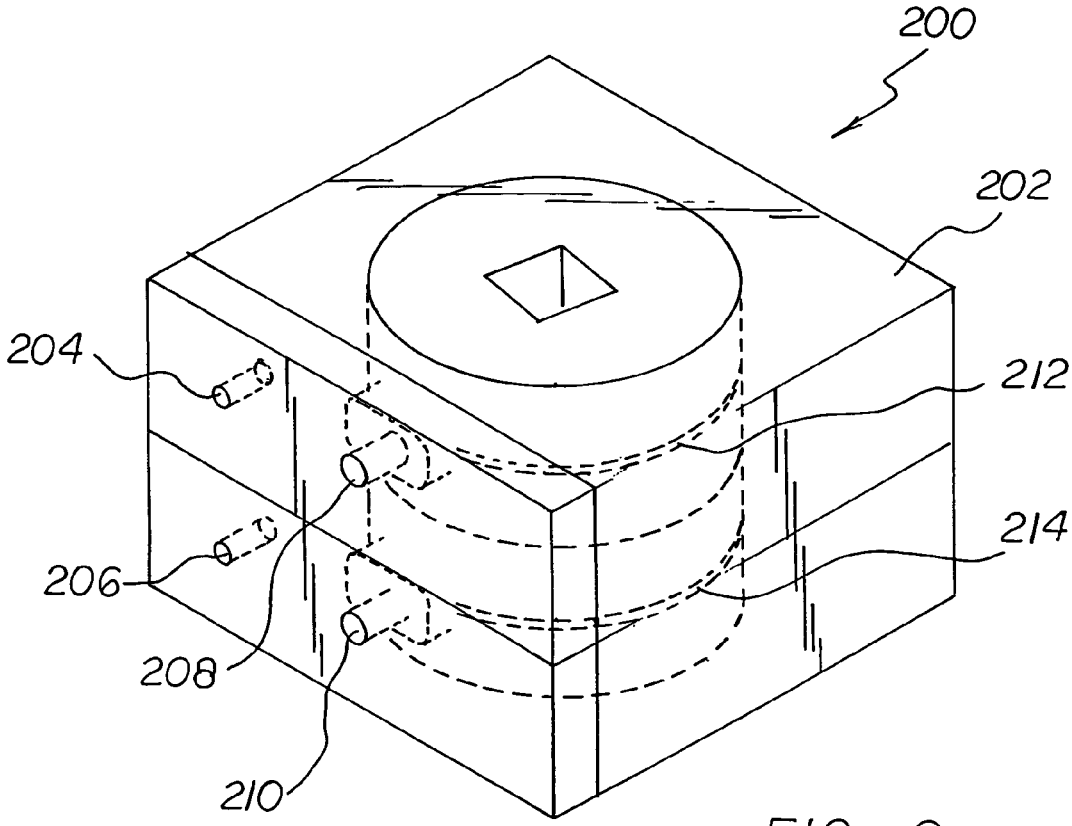
FIG. 9 is a perspective illustration of a block and die and wheel constructed in accordance with an alternate embodiment of the invention.

An alternate embodiment of the invention, the system 200, is shown in FIG. 9. In this embodiment, the block 202 has first and second entrance openings 204, 206 and the die has first and second exit openings 208, 210. The drive wheel has first and second grooves 212, 214. The first entrance opening and first exit opening and first groove are in a common first plane and the second entrance opening and second exit opening and second groove are in a common second plane.

The present invention enables the continuous manufacture of small grained materials. The materials thus manufactured have a high-strength. The chemical composition of the materials is not changed which is particularly advantageous for medical device applications. The present invention enables the continuous manufacture of small grained materials having superplastic properties. It enables the continuous manufacture of small grained materials having increased fatigue resistance. The present invention allows the continuous manufacture of small grained materials having increased stress corrosion resistance. It enables the continuous manufacture of small grained material having a texture that provides a high r-value, improving drawability and formability. The present invention enables the continuous manufacture of small grained materials having a high-quality surface finish. It enables the continuous manufacture of small grained materials having a variable output cross-section for downstream manufacturing.

In the present invention, the material is driven through the process by friction with the drive wheel. This is advantageous over the pushing or drawing in the prior art wherein pushing material through an ECA die cannot be made continuous and conventional drawing into an ECA die has been proven impossible. The present invention is the only continuous approach to ECA processing of materials.

The present invention incorporates a horizontal drive system with a large external containment girdle. The present invention includes a removable die that can be one or several pieces. This allows for changes to the buttress position and interior angles changing material characteristics and cross-section.

In the present invention, the enhanced material cross-section can be varied, reduced, eliminating the need for future processing.

Large forces contained in a girdle of tool steel prevent damage to the die and drive system of the present invention. Incorporated into the present invention is a sacrificial keyway to prevent damage to the drive system and a fail-safe operation in a production environment.

The present invention includes an exchangeable wheel which allows for the processing of various material sizes and strengths. The exchangeable wheel allows for the processing of various material shapes.

The present invention has the ability to drive several processing wheels stacked one on top of the other to enable advanced multi-pass processing, further refining grain size and producing isotropic characteristics, further increasing the resulting material strength.

The present invention allows the use of all conventional routes common in ECA pressing work.

The present invention can incorporate heating capability to heat the input material. It can also selectively heat the input material only in the region of massive shear. This insures sufficient column strength in the driving material to enable continuous ECA processing.

The present invention has carefully calibrated speed control to control torque applied to the processing system. This allows control over the material deformation rate and, therefore, material deformation behavior and final material strength.

The present invention is scalable to commercial sizes.

The present invention allows control of material porosity. No porosity is introduced in the final material through the process. This results in consistently high material characteristics in the output product.

The present invention enables control of material contamination. No contamination is introduced in the final material through the process. This results in consistently high material characteristics in output product.

In the present invention line-up of the drive system, wheel and die is critical to prevent damage to the die and groove and to reduce the potential of material blowing by the die.

The present invention is designed with a replaceable shoe into which the groove is located. This allows for changing the size of the groove and thus material size and replacing any worn or damages sections without replacing the entire groove or the entire wheel.

To reduce the frictional retarding force in the present invention, the outer ring of the wheel assembly has a groove into which a ring of material can be introduced to reduce the friction force significantly. The material utilized must resist deformation under the high normal forces experienced.

The die of the present invention has a small exit throat and built-in relief at the exit to the throat to ensure that the friction in the area of the shearing process is minimized.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A material processing system comprising:

a drive wheel having a generally cylindrical exterior surface with a circumferential groove;

a block having a cylindrical working surface in sliding contact with the drive wheel and an operational face having an opening extending there through;

a containment collar with a rectangular opening for receiving and supporting and containing the block, the containment collar having intake and extrusion holes; and a die located in the opening of the block the die having an interior surface constituting a continuation of the working surface of the block, the die also having an exit opening with a diverter secured to the die and extending into the opening of the block with a leading abutment edge positioned in operative proximity to the exit opening.

2. The system as set forth in claim 1 wherein the block has a single entrance opening and the die has a single exit opening and the drive wheel has a single groove, all in common plane.

3. The system as set forth in claim 1 wherein the block has first and second entrance openings and the die has first and second exit openings and the drive wheel has a first and second grooves the first entrance opening and first exit opening and first groove being in a common first plane and the second entrance opening and second exit opening and second groove being in a common second plane, this configuration could have several more identical levels.

4. A material processing system for continuously processing ultra-fine grain size materials comprising, in combination:

a drive wheel having a planar upper face and a parallel planar lower face with a generally cylindrical exterior surface located between the upper and lower faces and with a centrally located square interior drive extending between the upper and lower faces, the exterior surface having a circumferential groove with a square cross sectional configuration midway between the upper and lower faces, and a threaded aperture with a set screw extending between the drive hole and the exterior surface at an elevation between the groove and the upper face;

a rectilinear block having a planar upper face and a parallel planar lower face with a rectilinear exterior surface formed of four rectangular faces including an operational face located between the upper and lower faces and with a centrally located cylindrical working surface in sliding contact with the drive wheel, the operational face having a generally centrally located rectangular opening extending there through, the operational face also having a circular entrance opening located offset from the rectangular opening and extending from an input location exterior of the block to an output location tangential of the wheel and the groove;

a die located in the rectangular opening with a square exit extending from an input location interior of the die to a round relief exit then to an output location radially extending from the wheel and the groove, the die having an interior surface constituting a continuation of the cylindrical working surface of the rectilinear block;

an elongated arcuate diverter having a square cross section secured to the die and extending into the recess between the entrance and exit openings with a leading abutment edge positioned immediately following the exit opening;

a backing plate removably positioned over the operational face of the rectilinear block with unthreaded apertures extending through the backing plate and aligned threaded apertures in the rectilinear block and with bolts positioned though the unthreaded apertures and coupled to the threaded apertures to hold the die in place during operation and use, the backing plate having an entrance port aligned with the entrance opening of the rectilinear block and an exit port aligned with the exit opening of the die;

a containment collar with a rectangular opening for receiving and supporting the rectilinear block and the backing plate, the containment collar having intake and extrusion holes for movement of the workpiece there through;

a drive shaft including a rectangular section adapted to extend into the drive hole of the drive wheel and a circular plate adapted to be positioned on a central extent of the rectilinear block with a hook extending upwardly from the circular plate to facilitate the raising and lowering of the drive wheel with respect to the rectilinear block;

a work table for receiving the rectilinear block and the backing plate and the containment collar, the work table having a central opening beneath the drive hole of the wheel; and a motor secured to the work table beneath the central opening of the work table with an upstanding rectilinear drive block removably received within the drive hole of the drive wheel for rotating the wheel within the drive block to drive and pull a workpiece with an initial circular configuration into the square groove of the drive wheel in a path of travel to the abutment edge of the arcuate diverter then into the square exit which then opens into a round relief opening of the die and exterior of the system, it is at this point where the massive shear occurs, reducing the grain size and strengthening the material.

* * * * *